United States Patent [19]

Gorring et al.

[11] 3,968,024

[45] July 6, 1976

[54] CATALYTIC HYDRODEWAXING

[75] Inventors: Robert L. Gorring, Washington Crossing, Pa.; George F. Shipman, Trenton, N.J.

[73] Assignee: Mobil Oil Corporation, New York, N.Y.

[22] Filed: Jan. 6, 1975

[21] Appl. No.: 538,670

Related U.S. Application Data

[63] Continuation-in-part of Ser. No. 377,157, July 6, 1973, abandoned.

[52] U.S. Cl. ..... 208/111; 208/120; 208/135; 208/141; 252/455 Z; 252/477 R

[51] Int. Cl.[2] ..... C10G 13/02; C10G 11/04; B01J 29/28

[58] Field of Search ..... 208/111, 120

[56] References Cited

UNITED STATES PATENTS

| | | | |
|---|---|---|---|
| 3,313,594 | 4/1967 | Wilson | 423/329 |
| 3,323,876 | 6/1967 | Arey et al. | 252/455 Z |
| 3,458,454 | 7/1969 | Lapides et al. | 252/455 Z |
| 3,619,134 | 11/1971 | Park et al. | 423/329 |
| 3,620,963 | 11/1971 | Mulaskey | 208/111 |
| 3,663,430 | 5/1972 | Morris | 208/111 |
| 3,668,113 | 6/1972 | Burbidge et al. | 208/97 |
| 3,700,585 | 11/1972 | Chen et al. | 208/111 |
| 3,702,886 | 11/1972 | Argauer et al. | 423/328 |
| 3,766,093 | 10/1973 | Chu | 252/455 Z |
| 3,781,225 | 12/1973 | Schwartz | 252/455 Z |
| 3,832,449 | 8/1974 | Rosinski et al. | 423/328 |
| 3,867,277 | 2/1975 | Ward | 208/111 |
| 3,894,939 | 9/1975 | Garwood et al. | 208/111 |
| 3,926,782 | 12/1975 | Plank et al. | 208/111 X |

*Primary Examiner*—Delbert E. Gantz
*Assistant Examiner*—G. E. Schmitkons
*Attorney, Agent, or Firm*—Charles A. Huggett; Michael G. Gilman

[57] ABSTRACT

In the dewaxing of gas oils for the purpose of pour point reduction by catalytic hydrodewaxing using a catalyst comprising a crystalline aluminosilicate zeolite having a high silica to alumina ratio of at least 12 and a constraint index of about 1 to 12, carrying out the process at elevated temperature and pressure, including providing a hydrogen atmosphere in a preferred process configuration, the improvement of using a catalyst comprising said zeolite in microcrystalline from having a maximum crystal size of about 0.05 microns (M); and of operating the process at low pressures of up to about 500 psig, whereby not only is the catalytic activity increased but the catalyst aging rate is decreased and the product distribution is varied such that the process does not consume hydrogen but rather produces hydrogen or is at least neutral in this respect.

7 Claims, 1 Drawing Figure

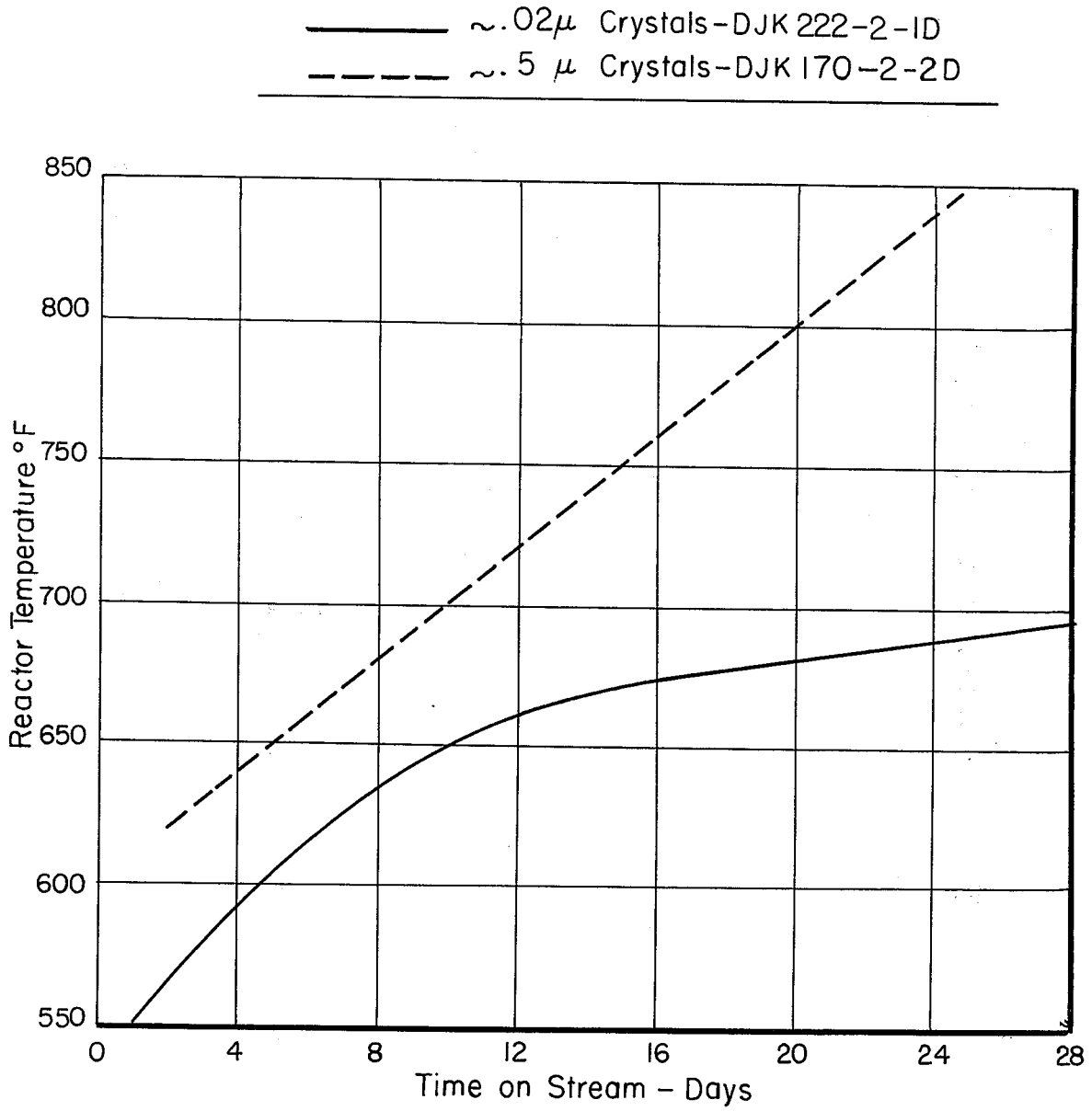
~.02μ Crystals-DJK 222-2-1D
~.5 μ Crystals-DJK 170-2-2D
850
800
750
700
650
600
550
Reactor Temperature °F
0
4
8
12
16
20
24
28
Time on Stream - Days

CATALYTIC HYDRODEWAXING

RELATED APPLICATION

This application is a continuation-in-part of application Ser. No. 377,157, filed July 6, 1973 now abandoned.

This invention relates to treatment and conversion of petroleum stocks using a special group of zeolite catalysts. It more particularly refers to catalytic hydrodewaxing gas oils in order to lower their pour point.

The cracking and/or hydrocracking of petroleum stocks is in general well known and widely practiced. It is known to use various zeolites to catalyze cracking and/or hydrocracking processes.

Of particular recent interest has been the use of a novel class of catalysts to assist in the dewaxing of gas oils, lube base stocks, kerosines and whole crudes, including syn crudes obtained from shale, tar sands and coal hydrogenation. U.S. Pat. No. 3,700,585 discloses the use of ZSM-5 type zeolites to efficiently catalyze dewaxing of various petroleum feed stocks.

U.S. Pat. No. 3,700,585 discloses and claims the cracking and hydrocracking of paraffinic materials from various hydrocarbon feedstocks by contacting such feedstock with a ZSM-5 type zeolite at about 550° to 1100°F, 0.5 to 200 WHSV and a hydrogen atmosphere in some cases. This patent is based upon work on the dewaxing of gas oils, particularly virgin gas oils, and crudes although its disclosure and claims are applicable to the dewaxing of any mixture of straight chain, slightly branched chain and other configuration hydrocarbons. The catalyst may have a hydrogenation/dehydrogenation component incorporated therein.

In the usual situation, hydrocarbon conversions which are carried out using heterogeneous catalysts are accompanied by progressive catalyst deactivation or aging. This may be due to the deposition of coke on the catalyst or to other causes. This seems to be true of amorphous or crystalline heterogeneous catalysts alike including reforming catalysts, illustrated by platinum on alumina; cracking catalysts, illustrated by faujasite type zeolites such as rare earth exchanged zeolite X; desulfurization catalysts, such as cobalt and molybdenum on alumina; and others. It is known that catalyst aging can be reduced or retarded by operating the referred to hydrocarbon conversion processes under hydrogen pressure. Thus, although reforming is a net producer of hydrogen, it is operated under added hydrogen pressure, by way of gas recycle, in order to maintain acceptable catalyst cycle life. It is also known that hydrocracking, for example, using a palladium-zeolite Y catalyst, has substantially lower catalyst aging rates than does catalytic cracking in the absence of added hydrogen. The state of the art, therefore, is that the imposition of hydrogen pressure tends to reduce catalyst aging and increase cycle life.

Catalytic hydrodewaxing can be considered to be a relatively mild, shape selective hydrocracking process. It is shape selective because of the inherent constraints of the catalyst pore size upon the molecular configurations which are converted. It is mild because the conversions of gas oil fed to lower boiling range products are small, e.g. usually below about 20 percent. It is operative over a wide temperature range but is usually carried out at relatively low temperatures, e.g. start of run temperatures of about 550°F are usual. It has been usual to employ added hydrogen in catalytic dewaxing processes and thereby produce a byproduct cracked gas stream which is good quality LPG, i.e. mainly $C_3$ and $C_4$ alkanes. It has also been generally believed that this added hydrogen was necessary or at least most desirable in order to achieve a process with a commercially useful catalyst cycle life.

It is an object of this invention to provide an improved process for carrying out catalytic dewaxing of gas oils.

It is another object of this invenion to provide a novel and improved process for reducing the pour point of gas oils.

It is a further object of this invention to provide a novel and improved process for reducing the viscosity and pour point of crude oils and to make them more pipelinable.

Other and additional objects of this invention will become apparent from a consideration of this entire specification including the claims hereof.

The known process to which this invention is directed is a process of upgrading and improving the quality of petroleum fractions, including whole crude, by contacting them under hydrodewaxing conditions of about 500° to 1100°F, space veocity of about 0.1 to 100 LHSV, hydrogen to hydrocarbon mole ratios of about 0 to 20, and a pressure of about 100 to 3000 psig and using a catalyst comprising a crystalline aluminosilicate zeolite having a high silica to alumina ratio of at least about 12, a constraint index of about 1 to 12 and, preferably, a crystal density of not substantially below about 1.6 grams per cubic centimeter. These operating parameters constitute the state of the art as represented by U.S. Pat. No. 3,700,585.

The instant invention resides in an improvement over that obtained by practicing the above described process under special conditions: using a catalyst comprising said zeolite having a very small, restricted crystal size of up to about 0.05 micron; and operating the process at a low pressure of up to about 500 psig. Preferred operating conditions include low pressures up to about 350 psig, low temperatures up to about 700°F, no added hydrogen, and a catalyst comprising microcrystalline ZSM-5 zeolite.

The zeolite herein described as being useful catalyst are members of a novel class of zeolites exhibiting some unusual properties. These zeolites induce profound transformations of aliphatic hydrocarbons to aromatic hydrocarbons in commercially desirable yields and are generally highly effective in conversion reactions involving aromatic hydrocarbons. Although they have unusually low alumina contents, i.e. high silica to alumina ratios, they are very active even when the silica to alumina ratio exceeds 30. The activity is surprising since catalytic activity is generally attributed to framework aluminum atoms and cations associated with these aluminum atoms. These zeolites retain their crystallinity for long periods in spite of the presence of steam at high temperature which induces irreversible collapse of the framework of other zeolites, e.g. of the X and A type. Furthermore, carbonaceous deposits, when formed, may be removed by burning at higher than usual temperatures to restore activity. In many environments the zeolites of this class exhibit very low coke forming capability, conducive to very long times on stream between burning regenerations.

An important characteristic of the crystal structure of this class of zelites is that it provides constrained access to, and egress from, the intra-crystalline free space by virtue of having a pore dimension greater than about 5 Angstroms and pore windows of about a size such as would be provided by 10-membered rings of oxygen atoms. It is to be understood, of course, that these rings are those formed by the regular disposition of the tetrahedra making up the anionic framework of the crystalline aluminosilicate, the oxygen atoms themselves being bonded to the silicon or aluminum atoms at the centers of the tetrahedra. Briefly, the preferred zeolites useful in this invention possess, in combination: a silica to alumina ratio of at least about 12; and a structure providing constrained access to the crystalline free space.

The silica to alumina ratio referred to may be determined by conventional analysis. This ratio is meant to represent, as closely as possible, the ratio in the rigid anionic framework of the zeolite crystal and to exclude aluminum in the binder or in cationic or other form within the channels. Although zeolites with a silica to alumina ratio of at least 12 are useful catalysts, it is preferred to use zeolites having higher ratios of at least about 30. Such zeolites, after activation, acquire an intracrystalline sorption capacity for normal hexane which is greater than that for water, i.e. they exhibit "hydrophobic" properties. It is believed that this hydrophobic character is advantageous in the present invention.

The zeolites useful in this invention freely sorb normal hexane and have a pore dimension greater than about 5 Angstroms. In addition, the structure must provide constrained access to larger molecules. It is sometimes possible to judge from a known crystal structure whether such constrained access exists. For example, if the only pore windows in a crystal are formed by 8-membered rings of oxygen atoms, then access by molecules of larger cross-section than normal hexane is excluded and the zeolite is not of the desired type. Windows of 10-membered rings are preferred, although excessive puckering or pore blockage may render these catalysts ineffective. Twelve-membered rings do not generally appear to offer sufficient constraint to produce the advantageous conversions, although structures can be conceived, due to pore blockage or other cause, that may be operative.

Rather than attempt to judge from crystal structure whether or not a zeolite possesses the necessary constrained access, a simple determination of the "constraint index" may be made by passing continuously a mixture of equal weight of normal hexane and 3-methylpentane over a small sample approximately 1 gram or less, of zeolite at atmospheric pressure according to the following procedure. A sample of the zeolite in the form of pellets or extrudate, is crushed to a particle size about that of coarse sand and mounted in a glass tube. Prior to testing, the zeolite is treated with a stream of air at 1000°F for at least 15 minutes. The zeolite is then flushed with helium and the temperature adjusted between 550°F and 950°F to give an overall conversion between 10% and 60%. The mixture of hydrocarbons is passed at 1 liquid hourly space velocity (i.e., 1 volume of liquid hydrocarbon per volume of catalyst per hour) over the zeolite with a helium dilution to give a helium to total hydrocarbon mole ratio of 4:1. After 20 minutes on stream, a sample of the effluent is taken and analyzed, most conveniently by gas chromatography, to determine the fraction remaining unchanged for each of the two hydrocarbons.

The "constraint index" is calculated as follows:

$$\text{Constraint Index} = \frac{\log_{10}(\text{fraction of n-hexane remaining})}{\log_{10}(\text{fraction of 3-methylpentane remaining})}$$

The constraint index approximates the ratio of the cracking rate constants for the two hydrocarbons. Catalysts suitable for the present invention are those utilizing a zeolite having a constraint index from 1.0 to 12.0. Constraint Index (CI) values for some typical zeolites including some not within the scope of this invention are:

| Material | C.I. |
|---|---|
| ZSM-5 | 8.3 |
| ZSM-11 | 8.7 |
| TMA Offretite | 3.7 |
| ZSM-12 | 2 |
| TEA Mordenite | 2 |
| Beta | 0.6 |
| ZSM-4 | 0.5 |
| H-Zeolon | 0.5 |
| REY | 0.4 |
| Amorphous Silica-alumina | 0.6 |
| Erionite | 38 |

The class of zeolites defined herein is exemplified by ZSM-5, ZSM-11, ZSM-12, ZSM-21, TEA mordenite and other similar materials. Recently issued U.S. Pat. Nos. 3,702,886 describing and claiming ZSM-5 is incorporated herein by reference.

ZSM-11 is more particularly described in U.S. Pat. No. 3,709,979, the entire contents of which are incorporated herein by reference.

ZSM-12 is more particularly described in U.S. Pat. No. 3,832,449, the entire contents of which are incorporated herein by reference.

ZSM-21 is more particularly described in U.S. application, Ser. No. 358,192, filed May 7, 1973, the entire contents of which are incorporated herein by reference.

TEA Mordenite is more particularly described in U.S. application Ser. No. 500,805, filed Aug. 26, 1974, the entire contents of which are incorporated herein by reference.

The specific zeolites described, when prepared in the presence of organic cations, are substantially catalytically inactive, possibly because the intracrystalline free space is occupied by organic cations from the forming solution. They may be activated by heating in an inert atmosphere at 1000°F for one hour, for example, followed by base exchange with ammonium salts followed by calcination at 1000°F in air. The presence of organic cations in the forming solution may not be absolutely essential to the formation of this type zeolite; however, the presence of these cations does appear to favor the formation of this special type of zeolite. More generally, it is desirable to activate this type zeolite by base exchange with ammonium salts followed by calcination in air at about 1000°F for from about 15 minutes to about 24 hours.

Natural zeolites may sometimes be converted to this type zeolite by various activation procedures and other treatments such as base exchange, steaming, alumina extraction and calcination, alone or in combinations. Natural minerals which may be so treated include ferrierite, brewsterite, stilbite, dachiardite, epistilbite, heulandite and clinoptilolite. The preferred crystalline aluminosilicates are ZSM-5, ZSM-11, ZSM-12, ZSM- 21 and TEA mordenite, with ZSM-5 particularly preferred.

The zeolites used as catalysts in this invention may be in the hydrogen form or they may be base exchanged or impregnated to contain ammonium or a metal cation complement. It is desirable to calcine the zeolite after base exchange. The metal cations that may be present include any of the cations of the metals of Groups I through VIII of the periodic table. However, in the case of Group IA metals, the cation content should in no case be so large as to effectively inactivate the catalyst. For example, a completely sodium exchanged H-ZSM-5 is largely inactive in the present invention.

In a preferred aspect of this invention, the zeolites useful as catalysts herein are selected as those having a crystal framework density, in the dry hydrogen form, of not substantially below about 1.6 grams per cubic centimeter. It has been found that zeolites which satisfy all three of these criteria are most desired. Therefore, the preferred zeolites are those having a constraint index as defined above of about 1 to 12, a silica to alumina ratio of at least about 12 and a dried crystal density of not substantially less than about 1.6 grams per cubic centimeter. The dry density for known structures may be calculated from the number of silicon plus aluminum atoms per 1000 cubic Angstroms, as given, e.g., on page 19 of the article on Zeolite Structure by W. M. Meier. This paper, the entire contents of which are incorporated herein by reference, is included in "Proceedings of the Conference on Molecular Sieves, London, April 1967", published by the Society of Chemical Industry, London, 1968. When the crystal structure is unknown, the crystal framework density may be determined by classical pyknometer techniques. For example, it may be determined by immersing the dry hydrogen form of the zeolite in an organic solvent which is not sorbed by the crystal. It is possible that the unusual sustained activity and stability of this class of zeolites is associated with its high crystal anionic framework density of not less than about 1.6 grams per cubic centimeter. This high density of course must be associated with a relatively small amount of free space within the crystal, which might be expected to result in more stable structures. This free space, however, seems to be important as the locus of catalytic activity.

Crystal framework densities of some typical zeolites are:

| Zeolite | Void Volume | Framework Density |
|---|---|---|
| Ferrierite | 0.28 cc/cc | 1.76 g/cc |
| Mordenite | 0.28 | 1.7 |
| ZSM-5,-11 | 0.29 | 1.79 |
| Dachiardite | 0.32 | 1.72 |
| L | 0.32 | 1.61 |
| Clinoptilolite | 0.34 | 1.71 |
| Laumontite | 0.34 | 1.77 |
| ZSM-4 (Omega) | 0.38 | 1.65 |
| Heulandite | 0.39 | 1.69 |
| P | 0.41 | 1.57 |
| Offretite | 0.40 | 1.55 |
| Levynite | 0.40 | 1.54 |
| Erionite | 0.35 | 1.51 |
| Gmelinite | 0.44 | 1.46 |
| Chabazite | 0.47 | 1.45 |
| A | 0.5 | 1.3 |
| Y | 0.48 | 1.27 |

It should be understood that the crystal density and the silica to alumina ratio of the zeolites defined above as being useful in this invention are physical properties capable of being directly measured. The constraint index, however, is an indirect measurement. The constraint index is the ratio of certain relative cracking rates but it actually represents more than cracking activity, it represents the zeolite pore size and shape as well as its accessibility. The constraint index is determined by the test set forth above which is capable of being carried out under a range of conditions. The specification of a range of test conditions is necessary to accommodate different zeolites with different base activity levels. It also may introduce the possibility that some particular set of conditions can be chosen for some specific zeolite that will result in a constraint index being calculated for that particular test which is outside the prescribed operative and desired range of 1 to 12. It may be that this same zeolite can have its constraint index evaluated under other testing parameters, within those set forth above, to result in a calculated constraint index which is within the limits set forth above. It must, therefore, be understood that the constraint index property of the zeolites defined herein is an inclusive property rather than an exclusive property. That is, if a zeolite has a constraint index within 1 to 12 when measured according to the test set forth herein at any set of testing conditions, it is to be included within the defined group of desired catalytic zeolites. The fact that a different constraint index can be arrived at for the same zeolite by choosing other test conditions will not delete it from that defined group of desired zeolites which are said to be useful in this invention.

Zeolite catalysts, particularly cracking catalysts tend to become deactivated with use. This phenomenon is referred to as coking because the catalyst changes color, becoming darkened, upon aging. The zeolites of this invention are similar to other zeolites in that they become "coke deactivated" with usage. They are, however, markedly different from and significantly superior to other zeolites in that their coke deactivation rates are much lower, that is, inherent deactivation is at a slower rate than other zeolite cracking catalysts.

In the zeolite cracking catalyst art, it is generally recognized that there is a proportional relationship between activity and coke deactivation, that is as a catalyst becomes more active for cracking hydrocarbon molecules, it generally becomes more readily and heavily coked and thus deactivated. As noted above, it is conventional to reduce catalyst coking tendency by utilizing an atmospheric comprising hydrogen. This tends to prolong catalyst cycle life. It is also known that this use of hydrogen to reduce coking is a function of pressue, that is higher hydrogen pressures reduce coking more than lower hydrogen pressures.

It is, therefore, most surprising that the microcrystalline zeolite catalysts of this invention not only are more active than prior used macrocrystalline zeolites of the same crystal structure but age (coke deactivate) at a lower rate than do their prior used macrocrystalline sisters. Even more surprising is the fact that this process carried out with these small crystals when operated at the low pressures specified herein does not consume hydrogen whether or not a hydrogen atmosphere is used, in fact, at the preferred operating conditions, this process actually generates hydrogen. Thus, this is the anamolous situation of a "hydrocracking" process not consuming hydrogen but actually producing hydrogen.

The conversion process may be carried out in a fixed, fluidized or transport type (FCC) catalyst bed reaction zones, as desired. Conventional relationships exist between catalyst particle size and type of catalyst bed. Reactant flow may be up or down as desired. If hydrogen is used, it may flow co or counter-current to the hydrocarbon reactant.

The feed to the instant process has been said to be a petroleum fraction inclusive of whole crude. Catalytic hydrodewaxing traditionally is a process intended for use in lowering the pour point, and also incidentally the cloud point, of No. 2 or Diesel fuel. This means that this named process is intended to operate on a gas oil feed. This may be full range atmospheric gas oil, e.g. having a boiling range in the range of about 330° to 750°F. It may also be some fraction of this cut, e.g. heavy atmospheric gas oil having a boiling range of about 500° to 750°F. While these are the traditional feeds to catalytic hydrodewaxing processes, the instant invention is by no means limited thereto.

It is within the scope of this invention to treat whole crude oil before fractionation. It is also appropriate to so treat atmospheric residua and/or vacuum gas oil. Further, included within scope of this invention are the treatment of lube oil base stocks, syn crudes from shale, tar sands and/or liquified coal. Wide boiling range petroleum fractions such as mixtures of naphtha (or reformate) and gas oils can be used. As noted above, hydrogen need not be included as a co-feed. It may be used if desired. In the alternative, other hydrogen contributing materials such as light olefins and/or lower alcohols can be co-fed within the scope of this invention.

This invention will be illustrated by the following Examples which are not limiting upon the scope thereof. Parts and percentages are by weight unless expressly stated to be to the contrary.

| Example No. Properties | Examples 1 and 2 1 | 2 |
|---|---|---|
| Crystal size ($\mu$) | 0.02 | 0.5 |
| Silica/Alumina ratio | 72 | 73 |
| Nickel Content (Wt.%) | 0.76 | 0.68 |
| Sodium Content (Wt.%) | 0.02 | 0.05 |
| Particle Density (g/cc) | 1.06 | 1.11 |

Each of the above samples Ni H ZSM-5 was matrixed with 35 weight percent alumina binder and used to catalyze the hydrodewaxing of an Arab medium gas oil having a pour point of 48°F, a boiling range of 400° to 825°F and a sulfur content of 2.47%. The processing conditions were 2 LHSV, 100 psig and 2500 SCF/bbl hydrogen. The temperature of operation was varied in order to attempt to produce a product having a 0°F pour point at as high a liquid (330°F) yield as possible.

The accompanying drawing shows the comparative results of these two tests. In this regard it should be noted that higher required operating temperature indicates lower activity and that the higher the slope of the activity curve, the greater the deactivation rate. Therefore, initial activity was 55°F better for microcrystalline material, which activity differential continued to increase after a start up period of about 10 days. Further, it should be noted that while the deactivation rate of the two catalysts was the same during start up, which is in and of itself surprising in view of the differences in activity, this deaction rate significantly decreased after start up upon process line out.

Yields in both examples were:

| Example | 1 | 2 |
|---|---|---|
| Initial 330°F + yield (%) | 85.29 | 86.11 |
| Lined out 330°F + yield (%) | 90.28 | 89.73 |

A most surprising discovery was made in carrying out this process; there was a net production of hydrogen which was signficantly increased using the microcrystalline catalyst as opposed to the macrocrystalline material.

| Example | Net Hydrogen Production 1 | 2 |
|---|---|---|
| Initial (SCF/bbl) | 290 | 89 |
| Lined Out (SCF/bbl) | 145 | 62 |

It is unknown why the use of this catalyst should result in the net production of hydrogen. It is even more of a mystery as to why the microcrystalline form should increase the net hydrogen make.

As noted above, in addition to treating and converting gas oils with the microcrystalline catalyst of this invention, it is also most useful in converting whole crude in order to decrease its pour point and viscosity and to improve its pipelinability.

Crude petroleum as it is produced from wells is usually collected and pumped via a pipeline or through a tanker to a refinery where it is first distilled into various boiling range fractions and then suitably worked up by appropriate processes into product such as gasoline, heating oil, residual fuel, coke, etc. Crude oil varies in physical properties, such as viscosity, and in impurity composition depending upon the particular producing location. Sometimes crude oil is so viscous at ordinary temperatures that it must be heated and kept hot in order for it to be pumpable. It is of course expensive to heat crude for pumpability purposes and therefore it is preferred not to do so. Under some conditions it may be ecologically undesirable to pump hot crude oil through a pipeline, for example where the pipeline is through a region of perma frost. It is possible that the heat transmitted from a pipeline carrying hot crude will melt or at least soften perma frost and create swampy areas where "hard" albeit frozen, land existed before. Crude oil contains significant impurities in the form of sulfur, nitrogen and various metals and so it is desirable not to subject it to heat for extended time periods without careful control of all conditions in order to minimize uncontrolled conversion of crude fractions by the possible catalytic effects of one or more of these impurities.

It is also common to mix heavy crudes with light oil, cutter stock, which is recycled from a refinery to the producing location in order to reduce the viscosity of the crude to a pumpable level. Clearly in these days of oil shortages it is unwise, as well as uneconomical to maintain a petroleum fraction, cutter stock, in an internal loop and not permit its conversion into available fuel or lubricant values.

The term whole crude, as such is used herein, is intended to mean crude petroleum produced from wells by substantially any technique. It also includes syncrude, that is the unrefined petroleum product recovered from coal hydrogenation, tar sands extraction, shale oil conversion or the like. It can be said that the term, whole crude, means an unrefined, substantially liquid mass which is predominantly hydrocarbon in nature but which may or may not contain such non-hydrocarbon impurities as are often found in crude petroleum in the as produced form, that is oxygen, sulfur and/or nitrogen containing compounds, vanadium, iron, nickel and/or other metal containing compounds. Briefly it can be said that whole crude is an unrefined, substantially liquid, substantially hydrocarbon mass.

The term unrefined refers to refining in a petroleum refinery type operation and does not refer to various techniques or processes utilized to separate the crude from its natural environment, e.g. processes for separating it from such things as sand, silt, rock, shale and the like are not considered to be refining. The substantially hydrocarbon product emerging from these processes is "unrefined" as such term is used herein.

The term substantially liquid as used herein refers to the physical state of the whole crude at the conditions of catalytic treatment expressed and referred to herein, which includes elevated temperatures.

While it is not certain exactly what reactions are going on during this catalytic treatment of whole crude, it is believed that the higher molecular weight normal and slightly branched waxy paraffins are being selectively cracked to lower molecular weight materials. These lighter compounds remain in the liquid crude. This accomplishes two purposes: In the first place components which contribute mightily to poor viscosity characteristics, i.e. waxes, are removed from the crude; and in the second place these are replaced by lighter fractions of much lower inherent viscosity characteristics thus reducing the whole crude viscosity by dilution.

Some very interesting attributes of the process described herein, over and above the improved viscosity and pipelinability characteristics, are related to the fact that the instant process increases the production of lighter products as compared to heavy products when the converted whole crude is ultimately refined. This increase in light products is also accompanied by an improvement in the quality of these products.

Whole crude which has been catalytically treated according to this invention is suitable for direct introduction into a refinery processing sequence. The treated whole crude is fractionated to divide it up into typical refinery cuts or fractions, e.g. dry gas, LPG, naphtha, distillate, gas oil and residual. The distillate may in some cases be further divided into kerosine, fuel oil and Diesel fuel. The residua and gas oil may be subjected to treatment to recover lubricant fractions therefrom and/or may be catalytically cracked to increase the production of gasoline and fuel oil. Naphtha fractions may be reformed if desired.

It has been found that the fuel oil which is cut from whole crude treated according to this invention has a much lower pour point than the corresponding fuel oil fraction of the untreated whole crude therefore it is possible to take a fuel oil cut with a significantly higher end point while still meeting a given pour point specification. This permits the fuel oil cut to be much larger than could have been taken from the untreated whole crude. Further, the fuel oil cut from the untreated whole crude would conventionally have been subjected to dewaxing, solvent or catalytic, in order to lower its pour point to an acceptable level. This dewaxing reduces the volume of fuel oil. Thus the fuel oil fraction obtained from treated whole crude is larger because of its higher end point and because it need not subsequently be dewaxed to meet a pour point specification.

It is also within the spirit and scope of this invention to combine the above-described catalytic conversion of whole crude with one or more other hydrocarbon conversion processes prior to fractionation of the thus converted whole crude into its conventional components. That is to say, conventional petroleum processing envisions producing whole crude, subjecting the whole crude to fractionation and then to various conversion processes as desired to manufacture a given product slate. It is usual for each such downstream conversion to be associated with a given, appropriate purification procedure which usually includes distillation as at least one of its unit operations.

This aspect of the instant invention, that is converting whole crude, may foretell drastically revising total petroleum refinery thinking in that the whole crude may be subjected to one or a series of conversions before cutting it up into conventional fractions. By operating in this manner, it is possible to increase the efficiency of operation as a factor of scale, that is by using larger and fewer distillation operations, and to increase the yield of more desirable, lighter products at the expense of heavier, less valuable fractions. In this regard, it is an aspect of this invention to further convert modified whole crude oil, as hereinabove described, by subjecting it to further catalytic conversion with special catalysts which are capable of performing required functions on specific portions of the crude oil while leaving other portions substantially unaltered.

In this regard, it is appropriate to consider demetalization and desulfurization of modified whole crude. Shape selective desulfurization catalysts are known in the art. Cobalt and molybdenum are known catalysts for this use. Applying these catalysts on a substrate having a given pore structure gives them shape selectivity based upon such pore structure. Thus, cobalt-molybdenum on faujasite type zeolites gives a desulfurization capability through the gas oil fraction of crude oil. Cobalt-moly on alumina or on zirconia/titania limits such desulfurization to the fraction of crude oil boiling up to about 1000°F. This type catalyst does not attack the asphaltene or other very heavy portion of crude and therefore is not as rapidly deactivated by coke lay down. Further, the desulfurization of modified whole crude as set forth herein increases the production of light products since the sulfur containing molecules which are attacked are cracked to at least some extent to lower boiling materials. These lower boiling materials will in many cases be at least partly olefinic in nature thereby increasing their octane value in the gasoline boiling range fraction.

Another specific attribute of this aspect of this invention is in subjecting modified whole crude to conventional petroleum refining operations such as shape selective cracking of normal paraffins with an erionite type of zeolite catalyst. This process will tend to operate only on the naphtha and light distillate fractions, further reducing n-paraffin content whereby increasing octane number of the naphtha fraction and decreasing pour point of the distillate fraction.

It is, of course, within the spirit and scope of this invention to subject petroleum fraction to various conversions in the conventional manner after the modified whole crude is fractionated. These downstream processes will be more efficient because of the crude modification as set forth herein.

The following Examples are illustrative of the practice of this aspect of this invention. In these examples the catalyst used was a ZSM-5 zeolite having a crystal size of about 0.02 micron, a silica to alumina ratio of 57, a zinc content of 0.19 weight percent and a palladium content of 0.28 weight percent. The process was carried out at a space velocity of 2.0, a pressure of 70 psig. and a nominal temperature of 550°F. The reactor was upflow through a fixed catalyst particle bed.

TABLE

| Example No. | Feed | 3 | 4 | 5 | 6 |
|---|---|---|---|---|---|
| Hydrogen flow (SCFB) | | 1000 | 1000 | 1000 | 0 |
| Composition (Wt.%) | | | | | |
| $C_3/C_4$ | 1.8 | 5.9 | 4.6 | 3.2 | 1.8 |
| $C_5$ | 11.2 | | 18.3 | | |
| 380–850°F | 49.5 | | 40.8 | | |
| 850°F + | 37.5 | | 36.3 | | |
| Pour Point (whole crude °F) | +25 | | <−65 | −20 | 0 |
| (380–850°F-F) | +50 | | −25 | | |
| Viscosity (CS) | | | | | |
| 60°F | 48.8 | 27.7 | 33.03 | 42.06 | 38.9 |
| 100°F | 19.7 | 12.7 | | | |
| Gravity (°API) | 26.4 | | | | |
| Nitrogen (ppm) | 1600 | | | | |
| Sulfur (Wt.%) | 1.42 | 1.42 | | | |
| Nickel + Vanadium | 26 | | | | |
| Middle distillate | | | | | |
| Yield % | 29 | | 50 | | |
| End point for 0°F Pour Pt. | 670°F | | 930°F | | |
| Composition | | | | | |
| $C_5$ – 380°F | 11.2 | | 18.3 | 3.2 | 1.8 |
| 380–850°F | 49.5 | | 40.8 | | |
| 850°F+ | 37.5 | | 36.3 | | |

EXAMPLES 7–9

These Examples illustrate the peculiar phenomenon of decreased catalyst aging with decreasing process pressure. The charge stock was Arab medium gas oil having 2.47% sulfur, +48°F pour point and a boiling range of 400° to 825°F. Operating conditions were 2 LHSV and sufficient temperature to produce a maximum yield of 0°F or lower pour point No. 2 fuel oil. Hydrogen circulation rate was 2500 SCFB. The catalyst comprised NiZSM-5.

At 400 psig the aging rate was 15°F/day.

At 200 psig the aging rate was 11°F/day.

At 100 psig the aging rate was 9°F/day.

At 610°F and 100 psig, the product pour point was −25°F and there was a net hydrogen production of 89 SCFB with an 86% yield of No. 2 fuel oil.

At 624°F there was a 90% yield of No. 2 fuel oil with a 0°F pour point and a net hydrogen production of 62 SCFB.

At 667°F there was an 85% yield of No. 2 fuel oil with a −25°F pour point and a net hydrogen production of 66 SCFB.

EXAMPLE 10

By way of comparison, a high pour Libyan gas oil having a boiling range of 650° to 725°F processed over a substantially similar catalyst at similar operating conditions required to maximize 0°F pour point No. 2 fuel oil product but at a pressure of 750 psig it consumed 217 SCFB of hydrogen.

What is claimed is:

1. In the process of upgrading hydrocarbon feeds by contacting such with a catalyst comprising a crystalline aluminosilicate zeolite having a silica to alumina ratio of at least about 12 and a constraint index of about 1 to 12, at a temperature of about 500° to 1100°F, a space velocity of about 0.1 to 100 LHSV and a hydrogen to hydrocarbon mole ratio of about 0 to 20; the improvement, whereby eliminating net hydrogen consumption and increasing catalyst cycle life, which comprises: utilizing a catalyst comprising said zeolite having a crystal size of up to about 0.05 micron; and operating said process at a total pressure of up to about 500 psig.

2. The improved process claimed in claim 1 carried out at up to about 400 psig with a catalyst comprising ZSM-5 having a crystal size of about 0.02 micron.

3. The improved process claimed in claim 1 wherein said feed is a gas oil having a boiling range in the range of about 330° to 750°F.

4. The improved process claimed in claim 1 wherein said feed is whole crude.

5. The improved process claimed in claim 1 wherein said feed is atmospheric residua.

6. The improved process claimed in claim 1 operated under hydrogen pressure.

7. The improved process claimed in claim 2 wherein said catalyst comprises a ZSM-5 zeolite having at least one metal selected from the group consisting of zinc, cadmium, palladium and nickel incorporated therewith.

* * * * *